United States Patent [19]

Hoover

[11] Patent Number: 4,737,261

[45] Date of Patent: Apr. 12, 1988

[54] PROCESS FOR THE PRODUCTION OF PREMIUM GRADE NEEDLE COKE FROM A HYDROTREATED SRC MATERIAL

[75] Inventor: David Hoover, New Tripoli, Pa.

[73] Assignee: International Coal Refining Company, Allentown, Pa.

[21] Appl. No.: 657,862

[22] Filed: Oct. 5, 1984

[51] Int. Cl.[4] ..... C10B 55/00

[52] U.S. Cl. ..... 208/50; 208/58; 208/89; 208/131; 208/403

[58] Field of Search ..... 208/89, 95, 50, 58, 208/8 LE, 10, 254 H, 216 R, 217, 131

[56] References Cited

U.S. PATENT DOCUMENTS

| | | | |
|---|---|---|---|
| 3,162,594 | 12/1964 | Gorin | 208/57 |
| 3,617,515 | 11/1971 | Bloomer | 208/131 |
| 3,707,461 | 12/1972 | Gatsis | 208/54 |
| 3,891,538 | 6/1975 | Walkey | 208/50 |
| 3,947,346 | 3/1976 | Snell et al. | 208/8 LE |
| 4,029,749 | 6/1977 | Murakami | 423/449 |
| 4,043,898 | 8/1977 | Kegler | 208/50 |
| 4,116,815 | 9/1978 | Sunago et al. | 208/87 |
| 4,138,325 | 2/1979 | Beuther et al. | 208/50 |
| 4,178,229 | 12/1979 | McConaghy et al. | 208/56 |
| 4,179,352 | 12/1979 | Effron | 208/8 LE |
| 4,199,523 | 4/1980 | Rottig | 518/706 |
| 4,202,756 | 5/1980 | Murakami et al. | 208/8 LE |
| 4,210,517 | 7/1980 | Murakami et al. | 201/20 |
| 4,215,517 | 8/1980 | Everson | 52/202 |
| 4,235,703 | 11/1980 | Kegler et al. | 208/89 |
| 4,244,805 | 1/1981 | Metrailer | 208/127 |
| 4,292,165 | 9/1981 | Sooter | 208/131 |
| 4,295,954 | 10/1981 | Mitchell | 208/416 |
| 4,461,694 | 7/1984 | Givens et al. | 208/8 LE |

OTHER PUBLICATIONS

Kirk-Othmer Encyclopedia of Chemical Technology, Third Edition, vol. 11, pp. 464–466.

Lieberman, N. P. Cyclic Coking Step Demand Attention, in *Oil and Gas Journal*, Dec. 15, 1980, p. 71.

*Primary Examiner*—Helen M. S. Sneed
*Assistant Examiner*—Anthony McFarlane
*Attorney, Agent, or Firm*—James W. Hellwege

[57] ABSTRACT

The invention disclosed in this application is a process for the production of a premium grade needle coke which is historically feedstock dependent. The selected feedstock for this process is a hydrotreated SRC material (solvent refined coal) which produces a premium grade needle coke having a low ash, low sulfur and low solids content. The hydrotreating of the SRC material, before conversion to the premium grade needle coke, changes the molecular structure of the product by putting hydrogen therein and results in a different arrangement of the aromatic molecules in the resultant premium grade needle coke.

10 Claims, 1 Drawing Sheet

PROCESS FOR THE PRODUCTION OF PREMIUM GRADE NEEDLE COKE FROM A HYDROTREATED SRC MATERIAL

This invention relates to a process for the production of premium grade needle coke. The latter is utilized widely in the production of synthetic graphite, which is useful as potential electrodes in the production of metallurgical steel. During thermal coking to produce needle coke, the molecules of the feed material are rearranged in aromatic sheets. The variation of temperatures and pressures utilized in the coker reactor or in a downstream calcination step can do little to improve upon the quality of premium grade needle coke from a poor feedstock. In otherwords, if the feed material is inferior, there is little that can be done to provide a high quality (premium) needle coke.

Several factors combine to define the quality of premium needle coke derivative of a viable feedstock. These are the sulfur content, metals content, carbon value and degree of carbon alignment. It is well-accepted that the better the carbon alignment, the lower the coefficient of thermal expansion (CTE) of the resultant synthetic graphite produced from the premium grade needle coke. Another method in determining the carbon alignment in a needle coke product is by x-ray diffraction.

Needle coke is probably the most valuable grade of petroleum coke, which derives its name from its microscopic elongated crystalline structure. Because of its special properties, needle coke is in limited supply and viable synthetic graphite can only be prepared from high quality needle coke. The sulfur content present in the needle coke relates to the amount of "puffing" which will occur during graphitization. It is generally recognized that the quantity of sulfur should be mitigated, however, it is still within specification to have up to 1.0 wt. % sulfur in finished premium needle coke. The quantity of volatile matter in the needle coke relates to the electrical resistivity of the resultant synthetic graphite electrode. A higher volatile matter content reduces both density and increases porosity. The higher density relates to a higher current curing capacity, a better resistance to oxidation and a higher ultimate strength. The needle coke should also have a very small quantity of ash and vanadium.

This invention relates to the formation of high premium grade needle coke in a delayed coking process, i.e., the coke formation occurs inside the coke drum. In a typical coking process two coke drums are used in a "swing-bed" fashion, when one is filling with a batch of needle coke precursor the other drum is being unloaded. Usually the total time required to load and unload a drum is somewhere around 48 hours. As the resultant needle coke is an image of its precursor it is extremely important to properly select a feed material. The act of selecting a feedstock is truely more art than science. Because of yet unrealized parameters existent in the mechanism to achieve the needle coke, it is totally unpredictable as to what a minor or even slight change in the feedstock will have on the resultant product. And in the instant case it was totally surprising that the resultant high quality product is a derivative of hydrotreating an SRC product stream.

PRIOR ART

Most processes for the production of high quality needle coke focus primarily on feedstocks derived from petroleum processing or coal tar pitch. In U.S. Pat. No. 4,138,325 a petroleum derived gas oil is utilized to produce thermally cracked naphtha, coker naphtha and needle coke. In U.S. Pat. No. 4,235,703 a vacuum residual petroleum oil is catalytically demetalized, desulfurized and then fed to a coker to produce premium needle coke. In U.S. Pat. No. 4,178,229 another vacuum residual petroleum oil is processed by a hydrogen donor cracking technique to produce a feedstock for production of premium grade needle coke. In U.S. Pat. No. 4,043,898, a disclosure is made as to how feedstocks can be characterized by their volumetric average boiling point and API gravity and then blended to produce a premium grade needle coke feedstock. The above are representative of the use of petroleum derived materials for the production of needle coke.

In U.S. Pat. No. 4,116,815 a disclosure is made that coal tar and coal tar pitch with aromatic and aliphatic solvents have been utilized to purify the feed prior to coking to produce needle coke. In addition, U.S. Pat. No. 4,333,816 shows that coal tar pitch can be purified by filtration thereby improving the resultant needle coke structure.

Coal liquefaction products, as set forth in U.S. Pat. No. 4,029,749 and 4,210,517, have been utilized as precursors for the production of needle coke. In the former, a coal is liquefied in a suitable solvent and the product is distilled to recover the distillate fraction and then that fraction is coked to produce the desired needle coke. In the latter, a general description is provided that purified coal formed from liquefaction processing techniques possess the required atomic ratio to qualify as viable feed materials for the production of needle coke. The resultant atomic ratio of nitrogen plus oxygen plus sulfur divided by the quantity of carbon in the needle coke precursor must be less than 0.0445. This disclosure is completely silent as to the hydrotreating of a liquefaction product before coking and would actually teach to one of reasonable skill in the art that the needle coke precursor must have the stated adequate atomic ratio to produce a viable premium needle coke.

OBJECTS AND EMBODIMENTS

It is therefore an object of this invention to provide a process for the production of a premium grade needle coke using a new needle coke precursor feedstock.

Another object of this invention is to provide a process for the production of a premium grade needle coke utilizing a hydrotreated liquefaction product stream to reduce the number of heteroatoms, i.e., sulfur, oxygen and nitrogen, and to change the molecular structure of the precursor so that a more advantageous arrangement of aromatic sheets are existent in the resultant premium grade needle coke.

Another object of this invention is to locate and make available a viable and relatively inexpensive feedstock material for this process to produce needle coke.

In one aspect the embodiment of this invention resides in a process for the production of premium grade needle coke which comprises coking, at a temperature of 850° to 950° F. and a pressure of about 1 atmosphere to about 100 psi, hydrotreated solvent refined coal to produce green needle coke and calcining said green needle coke at a temperature of 1500° F. to 2500° F. to produce needle coke.

And yet another embodiment of this invention resides in the production of a needle coke from a hydrotreated SRC material having a molecular weight ranging from 1,000 up to 30,000 and possessing an advantageous arrangement of aromatic sheets of molecules formed by hydrotreating the solvent refined coal in the presence of hydrogen at a temperature of 700° to 900° F., preheating said hydrotreated solvent refined coal to a temperature of 850° to 950° F., coking said heated hydrotreated solvent refined coal in a coker reactor at a pressure of 1 atmosphere to 100 psi and calcining said coked hydrotreated solvent refined coal material at temperatures ranging from 1500° F. to 2500° F. at a pressure of from atmospheric pressure to 100 atmospheres in the presence of a reducing gas to prepare said needle coke.

DETAILED DESCRIPTION OF THE DRAWING

Figure 1:
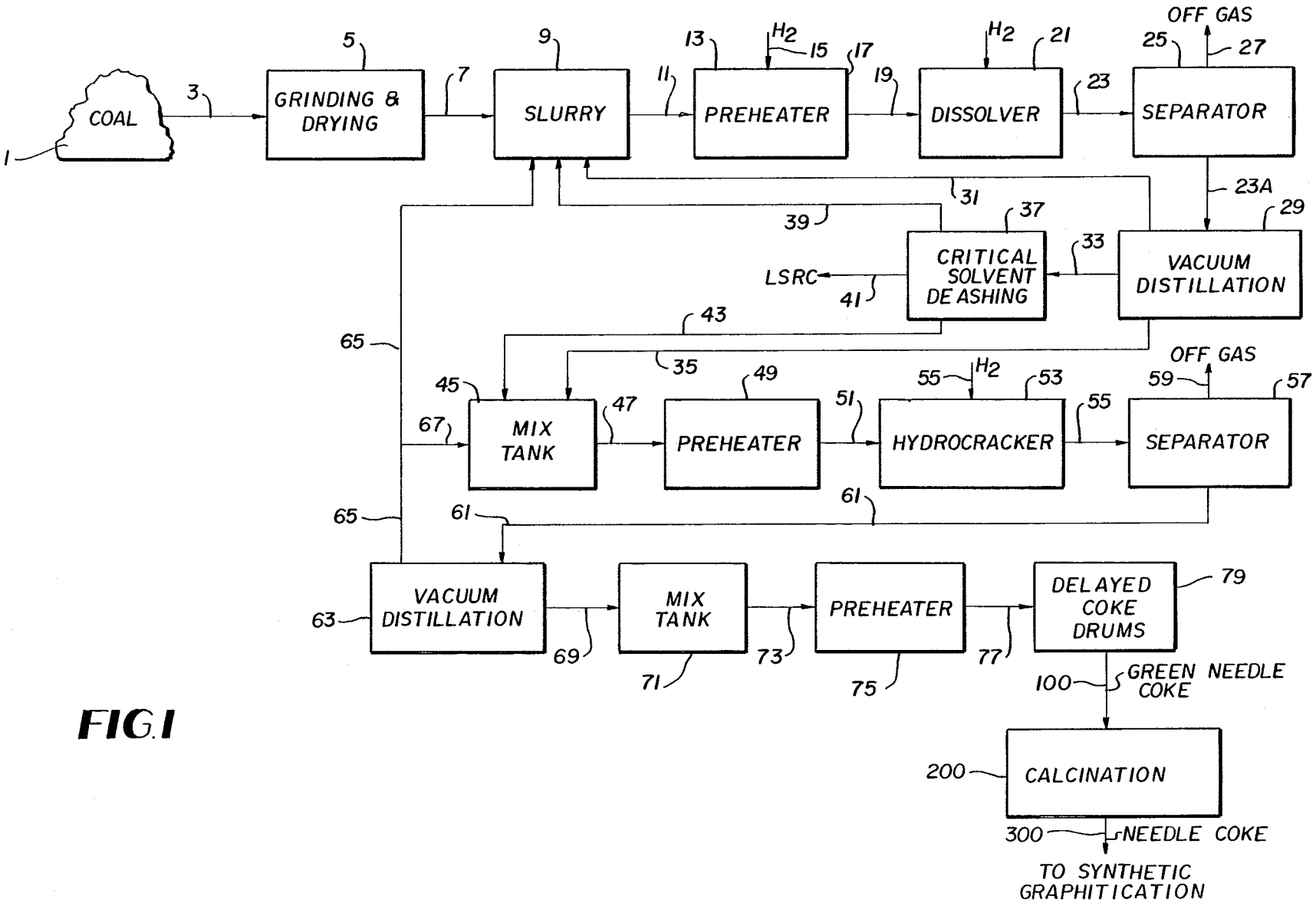
FIG. 1 is a basic flow design of the process of this invention.

In this process needle coke is produced in conduit means 300 from a beginning charge of coal 1 derived possibly from a strip or deep mine. While it is not a limitation upon the invention of this case, it is feasible that the coal possesses a relatively large sulfur content. An analysis of a typical feed material such as a Kentucky derived feed material is shown in Table I as follows:

TABLE I

| Feed Material Composition | Feed Coal |
|---|---|
| Carbon, wt % | 73.2 |
| Hydrogen, wt % | 4.9 |
| Oxygen, wt % | 10.0 |
| Nitrogen, wt % | 1.8 |
| Sulfur, wt % | 3.2 |
| Ash, wt % | 6.9 |
| Moisture, wt % | 1.6 |
| Dry Heating Value, Btu/lb | 13,250 |

The coal 1 is transmitted through conduit means 3 to grinding and drying unit 5 wherein the coal is ground to a specific size, preferably less than 200 mesh, and then dried. Subsequent thereto through conduit means 7, the coal is slurried with solvent in slurry zone 9. The solvent used to prepare the slurry is usually a process-derived solvent commonly nomenclated as "pasting oils" having a temperature ranging from about ambient up to about 400° F. Alternatively, an extrinsic pasting oil may be used such as a creosote oil, anthracene oil or other equivalent type of solvent. The feed coal, which can rank from lignite to anthracite, is present in a concentration in the slurry ranging from 20 to 55 percent by weight. The slurry mix tank is preferably maintained at elevated temperatures in order to keep the viscosity of the process solvent sufficiently low to have a viable pumping velocity and to allow moisture contained in the coal to escape as steam. The coal slurry is passed via a pumping unit in conduit means 11 to preheater 13. Downstream of the pumping unit (not shown on the drawing) a higher pressure of about 500 to 3200 psig (35.2 to 225.0 kg/cm$^3$ gauge), will be existent. The slurry is mixed with extrinsic hydrogen passed through conduit means 15, which may be a hydrogen rich gaseous stream having a ratio ranging from 10,000 to 40,000 standard cubic feet per ton (312 to 1,248 m$^3$ per metric ton) of the coal feed. This produces a three phase gas/-slurry stream present in preheater 17. The temperature of the three phase gas/slurry stream is increased to a temperature of 500° to 850° F. (315.6° to 454.4° C.). At this point the slurry is primed for release of the desired products.

From preheater 17, the slurry passes via conduit means 19 to dissolver vessel 21. This may comprise one or more dissolver vessels, which may be tubular reactors operated in an adiabatic mode without the addition of significant external heat. The length to diameter ratios of the dissolver vessels are usually considerably less than 200.

At this point the three phase slurry system undergoes a chemical transformation wherein the coal is further dissolved into the liquid, hydrogen is transferred from the recycle solvent to the coal, rehydrogenation of the recycle solvent takes place and heteroatoms such as sulfur, nitrogen and oxygen etc. are removed from the coal. The superficial flow through the dissolver will generally be at a rate of about 0.003 to 0.1 ft/sec. (0.091 to 3.048 cm/sec) for the condensed slurry phase and from about 0.05 to 3.0 ft/sec (1.524 to 91.44 cm/sec) for the gas phase. These rates may be selected by anyone of reasonable skill in the art to maintain good agitation of the reactor and insure good mixing. The ratio of hydrogen gas to coal slurry is maintained at a level sufficient to insure an adequate concentration in the exit slurry and to prevent coking in the reactor. The amount of time necessary in the dissolver vessels is chosen with respect to the particular coal slurry, incipient mineral particles and hydrogen content as the material moves through the dissolver. Any solids which may accumulate in the dissolver may act to catalyze the reaction and a system is generally provided to remove the solid residue material from the bottom of the dissolver vessel or vessels.

The effluent from dissolver 21 is passed in conduit means 23 to a separator 25 for removal of off-gases in conduit vent means 27. This separator system is totally optional with the SRC operator and if desired the dissolver effluent stream in conduit means 23 can be charged directly to the vacuum distillation unit 29 via conduit means 23A. It should also be noted that the number of dissolvers present in the total process may be multiple and that extrinsic hydrogen may be added to any of the downstream multiple dissolvers in order to acquire the most viable effluent product.

The light gases withdrawn from separator 25 in conduit vent means 27 usually comprise hydrogen, hydrogen sulfide, carbon dioxide, ammonia, water and $C_1$ to $C_4$ hydrocarbons. The underflow of the separator in conduit 23A comprises a liquid/solvent slurry which is passed to vacuum distillation unit 29. Vacuum distillation tower 29 is typically operated at a pressure of from about 1 to 5 psi (0.07 to 0.35 kg/cm$^2$) and a bottoms temperature of about 500° to 700° F. (260° to 371.1° C.) to prepare three basic streams. A light distillate boiling up to 400° F. is removed as product oil. A middle distillate having a boiling range from 350° to 1,050° F. (176.7° to 565.6° C.) is withdrawn in conduit means 31. It is contemplated that all or a portion of this material is recycled to slurry mix tank 9 to slurry the ground and dried coal from 5. The higher boiling products including SRC, undissolved coal and mineral matter are pumped through conduit 33 to critical solvent deashing zone 37. The underflow of vacuum distillation tower 29 is removed via conduit 35 and optionally may be passed to mix tank 45 with proper removal of ash material such as employing a screen or filter element in conduit 35. A solvent refined coal (SRC) having an initial boiling point of about 850° F. (454.5° C.) is withdrawn through conduit means 43 for ultimate downstream passage to hydrocracker unit 53. In the critical solvent deashing process, (CSD) a treatment such as described in Kerr-Mcgee (U.S. Pat. No. 4,199,523) is undertaken which is now incorporated by reference. The pressure is maintained at about 1 to 5 psi (0.7 to 35 kg/cm$^2$) and a bottoms temperature of about 500° to 700° F. (260° to 373.1° C.) is utilized to produce a pasting oil in conduit means 39, which like the pasting oil derived from the vacuum distillation unit 29, may be used in whole or in part as pasting solvent for the slurry zone 9. A light SRC material is withdrawn from CSD unit 37 and exorcised from the process.

The underflow from CSD unit 37 may be removed in conduit means 43 containing material similar to that derived from the vacuum distillation column 29 in conduit means 35 after filtration for deashing. This again was the ubiquitous solvent refined coal having an initial boiling point of about 850° F. (454.5° C.). This product SRC material will be representative of the following composition set forth in Table II.

TABLE II

| SRC Product Composition | |
|---|---|
| | Product SRC |
| Carbon, wt % | 86.8 |
| Hydrogen, wt % | 6.0 |
| Oxygen, wt % | 4.1 |
| Nitrogen, wt % | 2.0 |
| Sulfur, wt % | 1.0 |
| Ash, wt % | 0.2 |

As can be seen, the sulfur content has dropped considerably vis-a-vis the feed in Table I in addition to a near complete removal of the amount of ash material. These fungible materials are blended in mix tank 45. It is clearly within the confines of this invention to use either or both SRC material in conduits 35 or 43. In either event, these deashed SRC materials are then passed after mixing in mix tank 45 to hydrocracker preheater 49 via conduit means 47. This preheater will indirectly heat the SRC derived materials to an adequate temperature before hydrocracking. The temperature previous to the hydrocracking unit is usually in the range of 600° to 850° F. The material in preheater 49 is withdrawn via conduit means 51 and channeled to hydrocracker 53 wherein extrinsic hydrogen is added via conduit means 55. The quantity of hydrogenrich gas added to the hydrocracker usually ranges between 10,000 to 100,000 SCF per ton of the SRC feed material. A typical hydrocracking unit will comprise a hydrocracking catalyst such as a nickel-molybdenum catalyst and the following hydrocracking reaction conditions are typically as follows.

TABLE III

| | |
|---|---|
| Reaction Temperature | 775° F. |
| Reactor Pressure | 2000 psig |
| $H_2$ Flow Rate | 16.7 scf/lb feed |
| WHSV* | 1.20 |
| Catalyst Age** | 74.1 |

*grams of feed/gram catalyst hour
**grams of SRC feed/gram of catalyst

The hydrotreated SRC product material is withdrawn from hydrocracker 53 in conduit means 55 having a reduced quantity of heteroatoms such as sulfur, nitrogen and oxygen and the product has a modified molecular structure, which surprisingly has been found to be a most advantageous needle coke precursor feed material for the coking step. If found necessary, optional separation vessel 57 may be provided to remove vent off-gas in conduit means 59 and the product therefrom channeled to a vacuum distillation column 63 by means of conduit 61. Vacuum distillation column 63 is used to remove pasting solvent via conduit means 65, which may also be bifurcated to provide solvent to mix tank 45 by means of conduit 67 for using in slurry tank 9. The material is then passed to a mix tank via conduit means 69, the mix tank being nomenclated herein as 71.

At this point the feed material is ready for the delayed coking drums. The mixture is pumped into a preheater furnance 75 by means of conduit 73 containing a pump (not shown on the drawing) which raises the temperature indirectly of the hydrotreated SRC material (feed to coker unit) to 850° to 900° F. The material leaving preheater 75 in conduit means 77 is charged to a delayed coking drum 79, wherein the temperature is maintained at a sufficient level so as to produce green needle coke. These temperatures in the coker drums are maintained for a time duration of up to 12 hours at a temperature of 850° to 950° F. or higher. A pressure of one atmosphere to 100 psi is also contemplated within the coking unit. A swing bed type of delayed coking unit can be provided, such as described in Leiberman, N.P. Cyclic Coking Step Demand Attention, in Oil and Gas Journal Dec. 15, 1980 at page 71. Another type of coking system is described in U.S. Pat. No. 3,617,515, wherein a non-petroleum fraction having a high content of condensed aromatics is coked to produce a carbon electrode grade coke in a swing-bed type reactor system. The disclosure of the latter is incorporated by reference in regard to the various types of coking techniques necessary to result in good green needle coke.

The green needle coke is removed from the delayed coking drums by means of conduit 100 and calcined in calcination zone 200. In the calcination zone, under calcination conditions, green coke begats needle coke. And the calcination conditions are usually totally thermal, with the presence of a reducing gas required such as a flue gas, at a temperature of about 1500° F. to 2500° F., wherein the calcination step is undertaken at atmospheric pressure. The needle coke is withdrawn via conduit 300 from calcination zone 200 as the ultimate product of this invention and passed to a synthetic graphitization process, whereby synthetic graphite is produced which can be utilized in the arts of high technology metallurgical steel production.

EXAMPLES

The following Examples are not to be construed as a limitation upon the invention, but are offered to show that different needle coke product is obtained utilizing a hydrotreated SRC material vis-a-vis a non-hydrotreated SRC entity and to vitiate any assumption that the atomic ratio of nitrogen plus oxygen plus sulfur divided by carbon must be within the stated value of Murakani et al, U.S. Pat. No. 4,210,517 to prepare a premium-grade needle coke.

EXAMPLE I

In this Example a product SRC material from an SRC process is recovered prior to any hydrocracking. This is synonymous with conduits 35 and 43 of FIG. 1. The SRC material contained the properties established in Table II above. A portion of this SRC material was subjected to hydrocracking under a variety of hydrocracking process conditions as shown in Table IV.

TABLE IV

| Hydrocracking Process Conditions | Sample A | Sample B | Sample C | Sample D |
|---|---|---|---|---|
| Reaction Temperature, °F. | 775 | 775 | 775 | 775 |
| Reactor Pressure, psig | 2000 | 2000 | 2000 | 2000 |
| $H_2$ Flow Rate, scf/lb feed | 19.6 | 16.7 | 14.9 | 18.7 |
| WHSV* | 1.03 | 1.20 | 1.21 | 2.1 |
| Catalyst Age** | 37.3 | 74.1 | 207.8 | NA |

*grams of feed/gram catalyst hour
**grams of SRC feed/gram of catalyst

This operation produced four Samples A-D of hydrotreated SRC product with varying compositions especially in relation to hydrogen content and heteroatom content as is shown in Table V.

TABLE V

| Hydrotreated SRC Composition | Sample A | Sample B | Sample C | Sample D |
|---|---|---|---|---|
| Carbon* | 89.5 | 87.9 | 88.9 | 88.9 |
| Hydrogen* | 5.7 | 5.5 | 5.6 | 7.4 |
| Oxygen* | 3.1 | 3.0 | 3.0 | 2.0 |
| Nitrogen* | 2.2 | 2.2 | 2.4 | 1.4 |
| Sulfur* | 0.5 | 0.5 | 0.5 | 0.4 |
| (N + O + S)/c Atomic Ratio | 0.049 | 0.049 | 0.051 | 0.032 |

*Weight %

The four samples of hydrotreated SRC shown in Table V, plus a nonhydrotreated SRC acquired before the mix tank 45 of the drawing shown in Table II were subjected to coking and calcining under the following conditions of Table VI:

TABLE VI

| Coking and Calcining Conditions | |
|---|---|
| Coking Temperature, of | 840° |
| Coking Time, hrs | 3 |
| Calcining Temperature, °F. | 1650° |
| Calcining Time, hrs | 2 |

The calcined coke was analyzed by x-ray diffraction to determine the degree of carbon alignment. The peak height ratios were determined at the locations of 002 and 100. Table VII reflects the relative peak height ratioswhere higher peak height ratio values reflect a higher degree of carbon structure and lower CTE.

TABLE VII

| X-Ray Analysis of Calcined Coke | 002/100 Peak Ratio* |
|---|---|
| Sample A | 17.0 |
| Sample B | 14.8 |
| Sample C | 17.3 |
| Sample D | 15.2 |
| Non-hydrotreated SRC | 11.4 |

*Values greater than 12.0 indicate a premium grade needle coke.

In many situations premium grade needle coke will possess a peak height ratio of greater than 12.0 equivalent to a CTE value of less than $8.0\times10^{-7}/°$ C. in comparison with non-premium grade needle coke of less than 12.0 and equivalent CTE value. In summation of this data, the needle coke derivative of the nonhydrotreated SRC possesses a relative peak height ratio of only 11.4, which is considerably substandard vis-a-vis any of the hydrotreated SRC samples. The needle coke of Samples A through D, derivative of a hydrotreated SRC feed material, all possess a peak height ratio of greater than 12.0 and the majority are greater than 15.0. The analytical experimental variances are normally ±1. It must be recognized that Samples A-D were all hydrotreated under different hydrotreating conditions. These differences are reflected in the variance of peak height ratio of Samples A-D. It is very surprising that hydrotreating of the SRC feed material enhanced the resultant premium grade needle coke of Samples A-D vis-a-vis the non-hydrotreated SRC material. And such a reflection is further established by the differences of the needle coke of Samples A and C versus the needle cokes of Samples B and D resultant from the variance in the hydrotreating conditions. These results indicate a high degree of carbon alignment and excellant needle coke structural characteristics.

One of reasonable skill in the art from following the teachings of Murakami et al., U.S. Pat. No. 4,210,517 would have no way to realize that the hydrotreating of the SRC material would produce a better premium grade needle coke. In addition, the nitrogen plus oxygen plus sulfur divided by carbon atomic ratio of Samples A, B and C are not within the minimum value of 0.0445 espoused by the patentees. In fact, the results of these samples are antithetical to the very purposes and teachings of the aforementioned patentees and therefore vitiate their teachings.

What is claimed is:

1. A process for the production of premium grade needle coke which consists essentially of the steps of providing a solvent refined coal feed, catalytically hydrocracking said solvent refined coal in the presence of a hydrocracking catalyst and hydrogen at a temperature in the range of from 500° to 900° F. and at a pressure of from 100 psig to 2000 psig, coking the catalytically hydrocracked solvent refined coal at a temperature of from 850° to 950° F. and a pressure of from 1 atmosphere to 100 psig to produce green needle coke, and calcining said green needle coke at a temperature of from 1500° to 2500° F. to produce premium grade needle coke.

2. The process of claim 1 further characterized in that the sulfur content of the catalytically hydrocracted solvent refining coal is less than 0.5 wt %.

3. The process of claim 1 wherein said catalytically hydrocracted solvent refined coal is indirectly heat exchanged prior to coking to a temperature of 850° to 950° F.

4. The process of claim 1 further characterized in that the coking time is from ¼ hour to 6 hours.

5. The process of claim 1 wherein said calcining time is from ¼ hour to 5 hours.

6. The process of claim 1 wherein said catalytically hydrocracted SRC feed material possesses a molecular weight of from 1,000 to 30,000.

7. The process of claim 1 wherein said needle coke and said catalytically hydrocracted SRC material possess a sulfur content of less than 0.5 percent sulfur, an ash content of less than 0.3 wt % ash and a solid residue content of less than 0.5 wt % solid particles.

8. The process of claim 1 wherein said coking occurs in a swing-bed coking system having at least two coker beds.

9. A needle coke product produced by the process of claim 1.

10. The product of claim 9 wherein said needle coke has an ash content of less than 0.2 wt %, a sulfur content of less than 0.5 wt % sulfure and a residual content less than 1.0 wt % solids.

* * * * *